US009683325B2

(12) United States Patent
Kim et al.

(10) Patent No.: US 9,683,325 B2
(45) Date of Patent: Jun. 20, 2017

(54) CLOTHES TREATING APPARATUS

(71) Applicant: LG ELECTRONICS INC., Seoul (KR)

(72) Inventors: Youngsuk Kim, Seoul (KR); Sangwook Hong, Seoul (KR); Hyojun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/884,038

(22) Filed: Oct. 15, 2015

(65) Prior Publication Data

US 2016/0115641 A1 Apr. 28, 2016

(30) Foreign Application Priority Data

Oct. 28, 2014 (KR) ..... 10-2014-0147299

(51) Int. Cl.
*D06F 58/24* (2006.01)
*D06F 58/02* (2006.01)
*D06F 58/20* (2006.01)

(52) U.S. Cl.
CPC ..... *D06F 58/24* (2013.01); *D06F 58/02* (2013.01); *D06F 58/206* (2013.01)

(58) Field of Classification Search
CPC ..... F26B 19/00; F26B 21/00; F26B 21/06; D06F 58/00; D06F 58/02; D06F 58/24; D06F 58/206
USPC ..... 34/595, 601, 610, 132; 68/19, 20; 8/149, 159
See application file for complete search history.

(56) References Cited

U.S. PATENT DOCUMENTS 2,142,042 A * 12/1938 Bowdoin ..... D06F 43/007 192/136
3,089,327 A * 5/1963 Stilwell, Jr. ..... D06F 29/02 68/139
4,621,438 A * 11/1986 Lanciaux ..... D06F 58/04 34/242

(Continued)

FOREIGN PATENT DOCUMENTS

CN 2867060 Y 2/2007
CN 101275797 10/2008

(Continued)

OTHER PUBLICATIONS

European Search Report dated Jan. 22, 2016 issued in Application No. 15190421.6.

(Continued)

*Primary Examiner* — Stephen M Gravini
(74) *Attorney, Agent, or Firm* — KED & Associates, LLP

(57) ABSTRACT

Provided is a clothes treating apparatus that includes a cabinet that defines an outer appearance of the clothes treating apparatus, a clothes receiving device provided in the cabinet and configured to receive clothes therein, a hot air supply device provided with a heat exchanger to heat air supplied into the clothes receiving device and a compressor connected to the heat exchanger to compress a refrigerant, and a bracket assembly provided in the cabinet to support the compressor. The bracket assembly may include a main bracket having a compressor accommodation region in which the compressor is accommodated and a sub-bracket that extends from the main bracket.

20 Claims, 6 Drawing Sheets

(56) References Cited

U.S. PATENT DOCUMENTS

| | | | | |
|---|---|---|---|---|
| 4,676,473 | A | 6/1987 | Giles | |
| 5,222,374 | A | 6/1993 | Thompson et al. | |
| 5,474,216 | A * | 12/1995 | Harrod | D06F 71/08 223/57 |
| 8,112,904 | B2 * | 2/2012 | Kono | D06F 25/00 34/201 |
| 8,418,378 | B2 * | 4/2013 | Nawrot | D06F 58/20 165/287 |
| RE44,795 | E * | 3/2014 | Kim | D06F 37/22 68/140 |
| 8,683,711 | B2 * | 4/2014 | Han | D06F 58/206 34/134 |
| 8,857,928 | B2 * | 10/2014 | Coxon | D06F 39/14 312/328 |
| 9,249,538 | B2 * | 2/2016 | Bison | D06F 58/24 |
| 9,328,452 | B2 * | 5/2016 | Hong | D06F 58/04 |
| 2011/0265523 | A1 * | 11/2011 | Bison | D06F 25/00 68/20 |
| 2014/0137423 | A1 * | 5/2014 | Chung | D06F 58/206 34/86 |
| 2014/0208603 | A1 | 7/2014 | Kim et al. | |
| 2014/0238086 | A1 * | 8/2014 | Choi | D06F 58/24 68/20 |
| 2014/0338219 | A1 * | 11/2014 | Son | D06F 33/02 34/549 |
| 2015/0345072 | A1 * | 12/2015 | Ko | D06F 58/203 34/493 |
| 2015/0361610 | A1 * | 12/2015 | Yano | D06F 67/04 414/13 |
| 2016/0115641 | A1 * | 4/2016 | Kim | D06F 58/206 34/132 |
| 2016/0138209 | A1 * | 5/2016 | Kitayama | D06F 58/24 34/499 |
| 2016/0201252 | A1 * | 7/2016 | Lee | D06F 58/02 34/77 |

FOREIGN PATENT DOCUMENTS

| | | | | |
|---|---|---|---|---|
| CN | 101581025 | | 11/2009 | |
| CN | 2013748279 | | 4/2014 | |
| DE | 20-2014-000975 | U1 | 3/2014 | |
| EP | 2281934 | A1 | 2/2011 | |
| EP | 2 549 008 | | 1/2013 | |
| EP | 2 594 688 | | 5/2013 | |
| JP | 2005-337079 | A | 12/2005 | |
| JP | 2011-167223 | A | 9/2011 | |
| JP | WO 2014112103 | A1 * | 7/2014 | D06F 67/04 |
| KR | 20140065265 | A * | 5/2014 | D06F 58/206 |
| KR | CA 2833433 | A1 * | 5/2014 | D06F 58/206 |
| KR | EP 2735639 | A2 * | 5/2014 | D06F 58/206 |
| KR | EP 3015590 | A1 * | 5/2016 | D06F 58/206 |

OTHER PUBLICATIONS

Chinese Office Action issued in Application No. 201510684558.0 dated Apr. 18, 2017 (full Chinese text and full English translation).

* cited by examiner

CLOTHES TREATING APPARATUS

CROSS-REFERENCE TO RELATED APPLICATION(S)

Pursuant to 35 U.S.C. §119(a), this application claims the benefit of earlier filing date and right of priority to Korean Application No. 10-2014-0147299, filed on Oct. 28, 2014, the contents of which is incorporated by reference herein in its entirety.

BACKGROUND

1. Field

This specification relates to a structure for supporting a compressor provided in a clothes treating apparatus.

2. Background

A clothes treating apparatus commonly refers to a drying machine for drying clothes, a washing machine for washing and drying clothes, and a refresh apparatus for deodorizing or sterilizing clothes using steam.

The clothes treating apparatus employs a heat pump for supplying hot air or steam to clothes. The heat pump includes an evaporator for dehumidifying humid air, a condenser for heating the dehumidified air, and a compressor connected to the evaporator to compress a refrigerant and supply the compressed refrigerant to the condenser. The evaporator and the condenser refer to elements allowing for heat exchange between the refrigerant and surrounding air.

Therefore, performance of the compressor may determine an amount and temperature of hot air generated by the heat pump. However, the compressor may problematically generate vibration during a process of compressing the refrigerant.

If a capacity of the compressor increases to improve the performance of the compressor, a volume occupied by the compressor increases, which results in an increase in a volume of the clothes treating apparatus. Hence, an improved bracket assembly to support the compressor is desired.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Description will now be given in detail of the preferred embodiments according to the present disclosure, with reference to the accompanying drawings. Meanwhile, a configuration or control method to be described hereinafter is merely illustrative and will not limit the rights of the present disclosure. For the sake of brief description with reference to the drawings, the same or equivalent components may be provided with the same or similar reference numbers, and description thereof will not be repeated.

Figure 1:
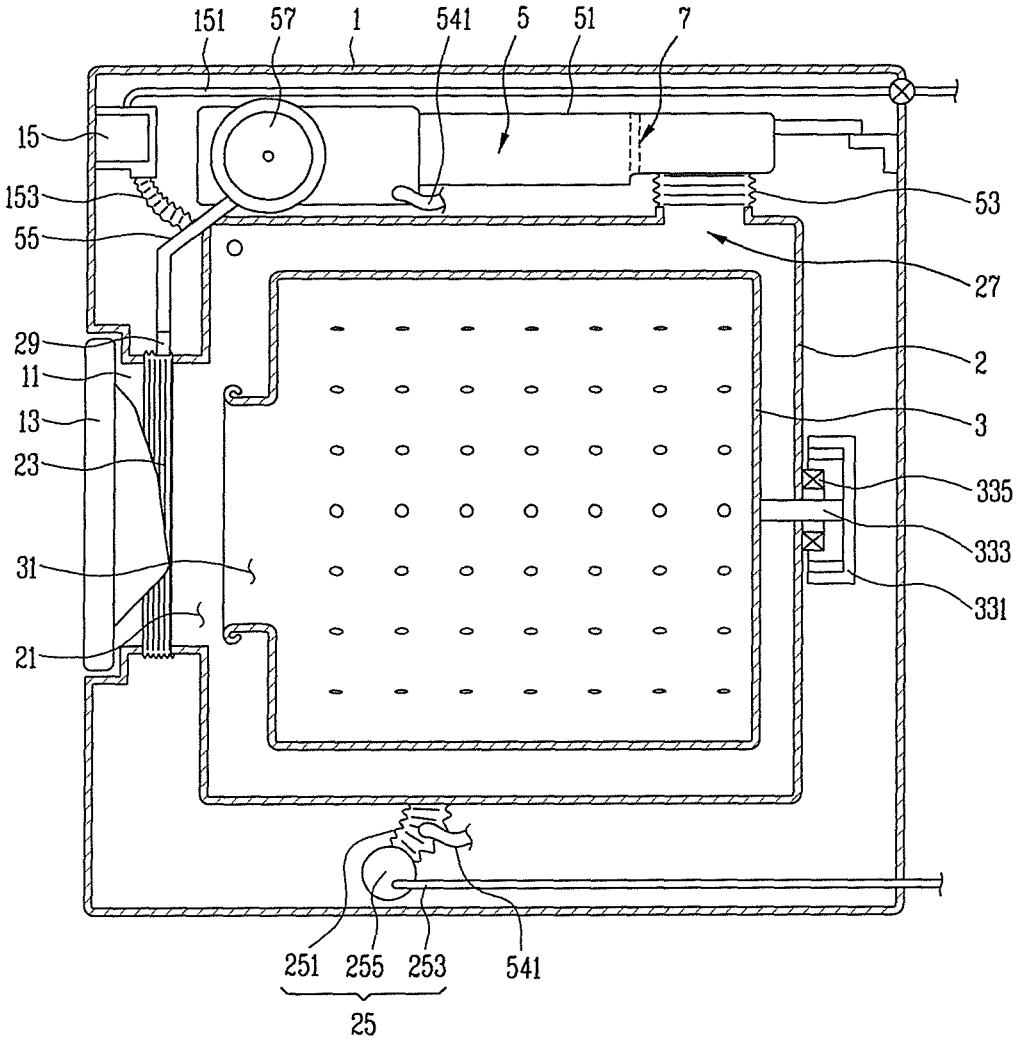
FIG. 1 is a sectional view of a clothes treating apparatus in accordance with one exemplary embodiment of the present disclosure.

FIG. 1 illustrates one embodiment of a clothes treating apparatus according to the present disclosure. As illustrated in FIG. 1, a clothes treating apparatus 100 may include a cabinet 1 that defines an outer appearance of the apparatus, a clothes receiving device 2 and 3 provided in the cabinet 1 to receive (store or accommodate) clothes therein, and a hot air supply device 5 that supplies hot air into the clothes receiving device 2 and 3.

The cabinet 1 includes an introduction opening 11 through which clothes is introduced therein, and a door 13 rotatably coupled to the cabinet 1 to open and close the introduction opening 11.

When the clothes treating apparatus 100 according to the present disclosure is merely configured as a drying machine which has a clothes drying function, the clothes receiving device 2 and 3 may include only a drum 3 rotatably disposed in the cabinet 1

However, when the clothes treating apparatus 100 is configured as an apparatus which has both functions of washing and drying clothes, the clothes treating apparatus 2 and 3 may include a tub 2 disposed in the cabinet 1 to store wash water therein, and a drum 3 rotatably disposed in the cabinet 2 to store the clothes therein.

The tub 2 has a cylindrical shape with a hollow inner space and is fixed in the cabinet 1. The tub 2 includes a tub introduction opening 21 formed at a front surface of the tub 2 facing the introduction opening 11, such that the clothes or laundry can be introduced and taken away therethrough.

A gasket 23 is provided between the tub introduction opening 11 and the introduction opening 11. The gasket 23 is a constituting element which prevents wash water stored in the tub 2 from being leaked out of the tub 2 and also prevents vibration generated in the tub 2 during rotation of the drum 3 from being transferred to the cabinet 1. Therefore, the gasket 23 may be made of a vibration-insulating material, such as rubber.

The tub 2 may be arranged in parallel to the ground, or to be inclined from the ground by a predetermined angle. However, when the tub 2 is inclined from the ground by the predetermined angle, the inclined angle of the tub 2 is preferably smaller than 90°.

An air exhaust portion 27 through which internal air of the tub 2 is exhausted is provided on an upper portion of a circumferential surface of the tub 2, and a water drain portion 25 through which the wash water stored in the tub 2 is discharged is provided below the tub 2.

The air exhaust portion 27 is provided on the upper surface of the tub 2, preferably, spaced apart from a straight line A, which passes through a center of the tub 2, by a predetermined distance L1 in a circumferential direction of the tub 2. This is for facilitating the internal air of the tub 2 to be discharged out of the tub 2 through the air exhaust portion 27 during the rotation of the drum 3.

The water drain portion 25 may include a first drain pipe 251 through which a drain pump 255 is connected to the tub 2, and a second drain pipe 253 guiding the wash water introduced into the drain pump 255 to the outside of the cabinet 1.

The tub 2 stores wash water that is supplied through a water supply pipe 151 which connects the tub 2 to a water supply source. Here, when a detergent supply unit 15 for supplying detergent is provided at the cabinet 1, the water supply pipe 151 may be configured to supply wash water to the detergent supply unit 15 therethrough. In this instance, the wash water supplied to the detergent supply unit 15 may then be supplied into the tub 2 through a detergent supply pipe 153.

The drum 3 may have a cylindrical shape with a hollow inner space, and be rotatably disposed in the tub 2. The drum 3 is rotatable by a driving unit provided at an outside of the tub 2.

In this instance, the driving unit may include a stator 335 fixed to a rear surface of the tub 2 to generate a magnetic field, a rotor 331 rotated by the magnetic field, and a rotation shaft 333 penetrating through the rear surface of the tub 2 to connect a rear surface of the drum 3 to the rotor 331.

In the meantime, the drum 3 may include a drum introduction opening 31 formed at a front surface thereof, so as to communicate with the introduction opening 11 and the tub introduction opening 21. A user may thus put clothes or laundry into the drum 3 and take the clothes stored in the drum 3 out of the cabinet 1 through the introduction opening 11.

Figure 2:
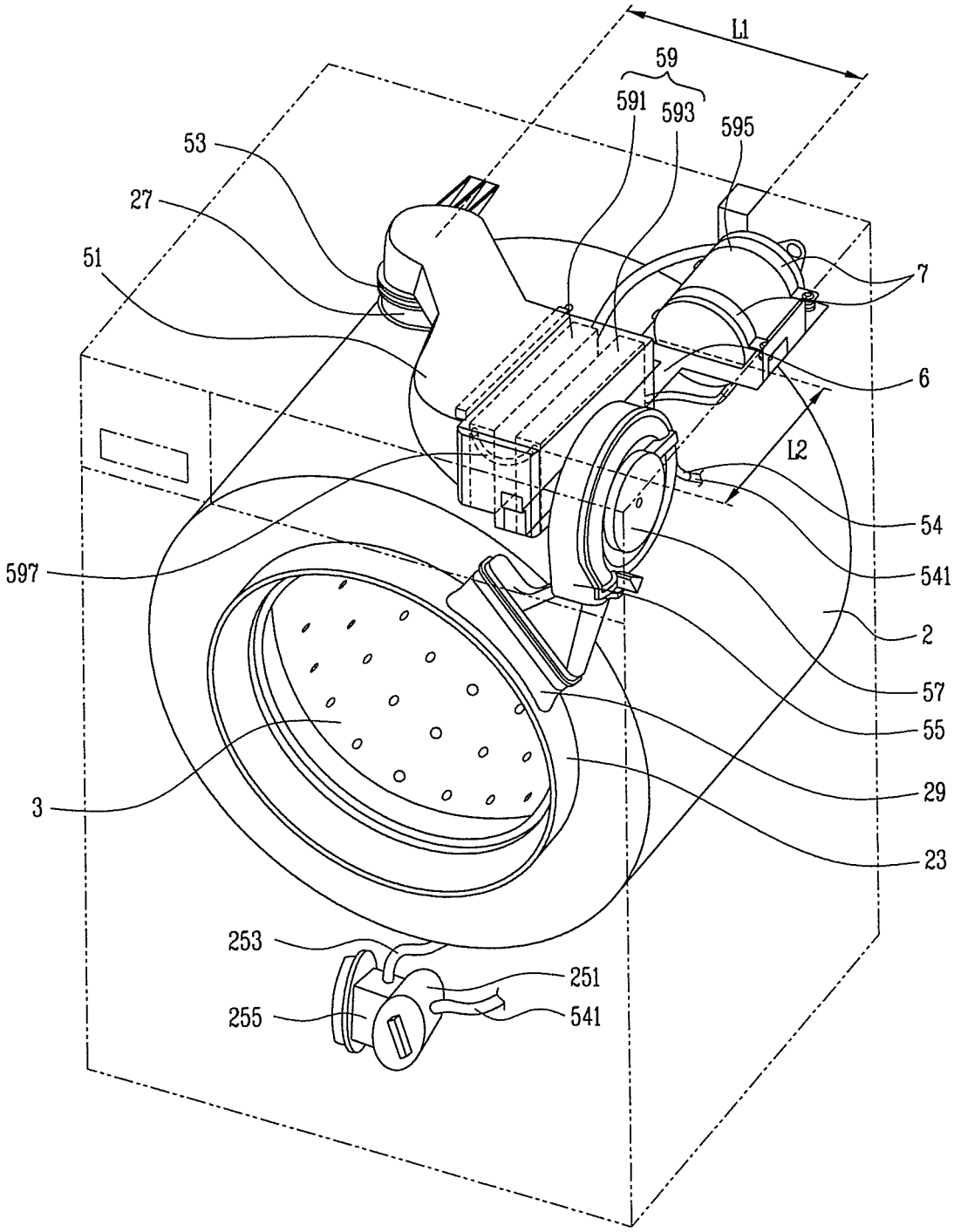
FIG. 2 is a perspective view of a clothes treating apparatus in accordance with one exemplary embodiment of the present disclosure.

As illustrated in FIG. 2, the hot air supply device 5 includes a circulation passage 51, 53 and 55 to guide air discharged from the tub 2 toward a front side of the tub 2, a blower 57 provided in the circulation passage 51, 53 and 55 to circulate internal air of the circulation passage, and a heat-exchanging device 59 provided in the circulation passage 51, 53 and 55.

The circulation passage may include a first connection duct 53 connected to the upper portion of the circumferential surface of the tub 2, a duct 51 connected to the first connection duct 53 and provided with the heat-exchanging device 59 therein, and a second connection duct 55 to guide air discharged from the duct 51 toward the front side of the tub 2.

The first connection duct 53 is a passage connected to the air exhaust portion 27 located at the upper portion of the circumferential surface of the tub 2, and preferably formed as a vibration-insulating member (rubber, etc.).

This is to prevent the vibration transferred to the tub 2 during the rotation of the drum from being carried to the heat-exchanging device 59 located in the duct 51 through the first connection duct 53.

To more efficiently prevent the vibration generated in the tub 2 from being transferred to the duct 51 and the heat-exchanging device 59, the first connection duct 53 may be formed in a shape of a bellows.

The second connection duct 55 may be connected to any area of the tub 2 if the area is allowed to guide the air discharged through the duct 51 toward the front side of the tub 2. FIG. 2 illustrates one example in which the second connection duct 55 allows air to be supplied into the tub 2 through the gasket 23. In this instance, the gasket 23 may further be provided with a supply portion 29 communicating with the second connection duct 55.

The blower 57 may be provided at the second connection duct 55. The blower 57 may include an impeller (not illustrated) located in the second connection duct 55, and an impeller motor (not illustrated) rotating the impeller.

Figure 3:
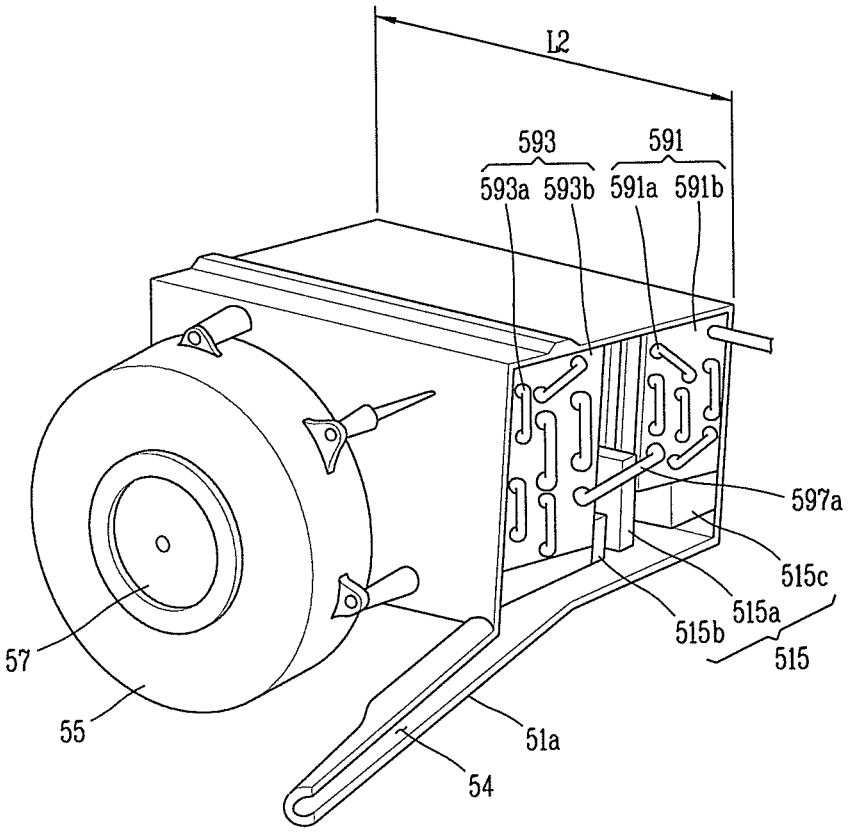
FIG. 3 is a perspective view of a heat exchanger of a clothes treating apparatus in accordance with one exemplary embodiment of the present disclosure.

FIG. 3 illustrates one example in which the heat-exchanging device 59 is configured as a heat pump.

In this instance, a first heat exchanger 591 (i.e., an evaporator) and a second heat exchanger 593 (i.e., a condenser) provided in the heat-exchanging device 59 are fixed in the duct 51. A compressor 595 compresses a refrigerant discharged from the evaporator 591 and supplies the compressed refrigerant to the condenser 593. The refrigerant supplied to the condenser 593 should be supplied back to the evaporator 591 through an expansion apparatus.

The evaporator 591 may be provided with a first heat-exchanging plate 591*b*, and a first refrigerant pipe 591*a* fixed to the first heat exchanger 591*b*.

The first heat exchanger 591*b* may be configured as a plurality of metal plates which are fixed in parallel in a lengthwise direction of the circulation passage (an air flowing direction). In this instance, the plurality of first heat-exchanging plates 591*b* may be disposed with being spaced apart from one another by a predetermined interval along a widthwise direction L2 of the circulation passage. The first refrigerant pipe 591*a* provides a flow path of the refrigerant and is fixed to the first heat-exchanging plate 591*b*.

In the evaporator 591, the refrigerant is evaporated by absorbing heat from air introduced into the duct 51. Therefore, the evaporator 591 serves to remove (dehumidify) moisture contained in air by cooling the air.

The duct 51 may further be provided with a condensed water discharge portion 54 through which moisture (condensed water) removed from air through the evaporator 591 is discharged out of the circulation passage. The condensed water discharge portion 54 may be connected to a water drain portion through a discharge pipe 541.

The condenser 593 condenses the refrigerant. Since heat generated during the process of condensing the refrigerant is transferred to air passing through the condenser, the condenser 593 serves to heat the air passed through the evaporator 591.

The condenser 593 may also be provided with a plurality of second heat-exchanging plates 593*b*, and a second refrigerant pipe 593*a* fixed to the second heat-exchanging plates 593*b*.

The evaporator 591 and the condenser 593 may be fixed to a first mounting surface 515 provided in the duct 51. The first mounting portion 515 may include a supporting portion 515*c* to support a lower surface of the evaporator 591, and a barrier wall 515*a* disposed between the evaporator 591 and the condenser 593. This structure is configured to prevent condensed water removed from air passed through the evaporator 591 from flowing into the condenser 593, and also facilitate the condensed water to flow toward the condensed water discharge portion 54.

As illustrated in FIG. 4, the circulation passage according to the present disclosure is located on an upper portion of the circumferential surface of the tub 2, and accordingly, a space where the evaporator 591 is located and a space where the condenser 593 is located may have different volumes from each other.

If a duct height of a fixing area of the evaporator 591 is different from a duct height of a fixing area of the condenser 593, a quantity of heat exchange of the evaporator 591 and a quantity of heat exchange of the condenser 591 may be unbalanced.

In this instance, since the volume of the evaporator 591 or the condenser 593 is limited due to a shape of the duct 51, it may be difficult to solve the unbalanced quantity of heat exchange between the evaporator and the condenser by increasing the volume of the evaporator or condenser.

Figure 4A:
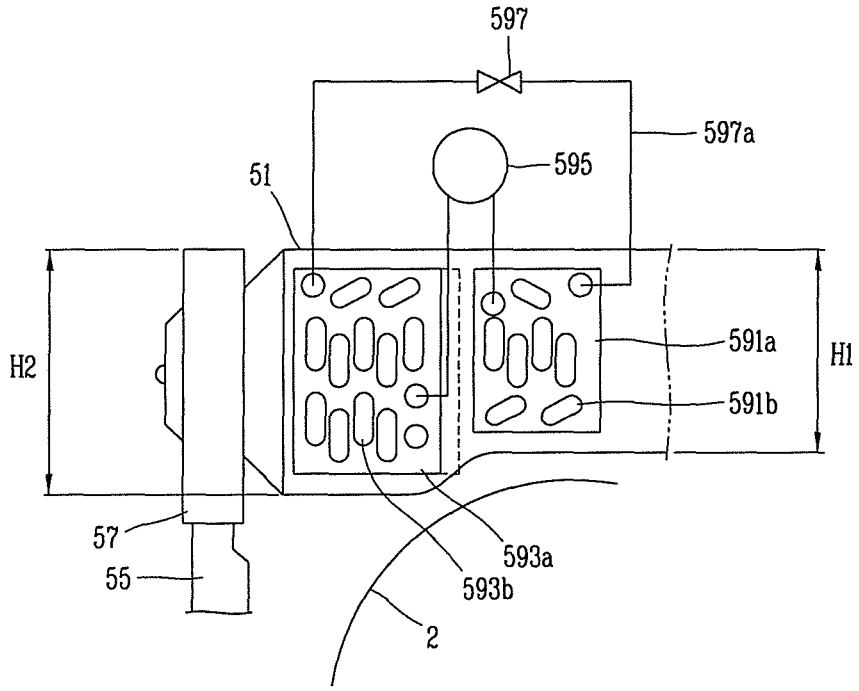
FIGS. 4A and 4B are sectional views of a heat exchanger of a clothes treating apparatus in accordance with one exemplary embodiment of the present disclosure.

Further referring to FIG. 4A, even though trying to increase a length of the condenser 593 toward the evaporator 591 in order to increase the volume of the condenser 593, it may be interrupted due to the duct 51. Hence, the increase in the length of the condenser is difficult without the change in the shape of the duct.

To solve this problem, the condenser 593 according to the present disclosure may be configured in a manner that a part of the refrigerant pipe thereof is fixed to the heat-exchanging plate of the evaporator 591.

Figure 4B:
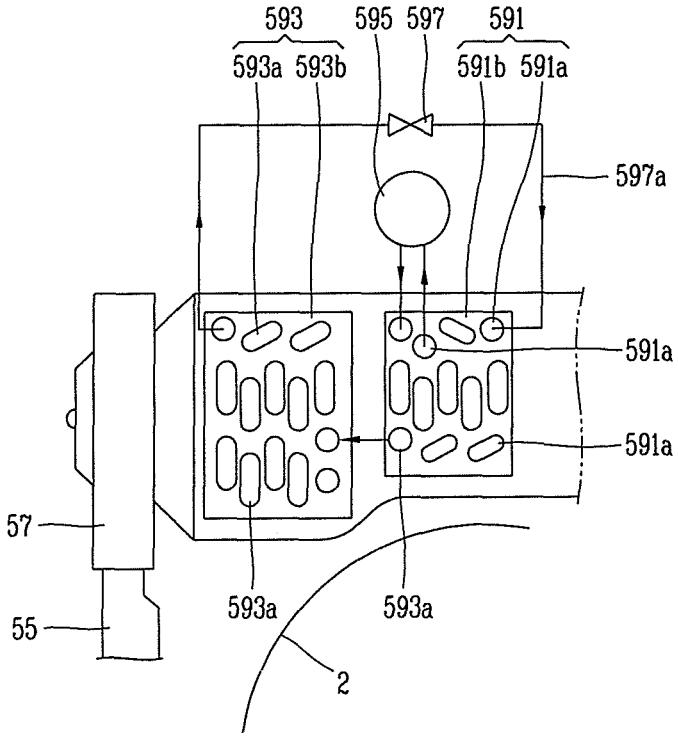

As illustrated in FIG. 4B, in the structure that the evaporator 591 includes the first heat-exchanging plate 591*b* and the first refrigerant pipe 591*a* fixed to the first heat-exchanging plate 591*b*, and the condenser 593 includes the second heat-exchanging plate 593*b* to perform heat exchange with air passed through the first heat-exchanging plate 591*b* and the second refrigerant pipe 593*a* fixed to the second heat-exchanging plate 593*b*, a part of the second refrigerant pipe 593*a* may be fixed to the first heat-exchanging plate 591*b*.

Here, a refrigerant passed through the first heat-exchanging plate 591*b* through the first refrigerant pipe 591*a* should be supplied to the first heat-exchanging plate 591*b* and the second heat-exchanging plate 593*b* through the second refrigerant pipe 593*a* via the compressor 595, and a refrigerant discharged from the second heat-exchanging plate 593*b* through the second refrigerant pipe 593*a* should be supplied back to the first refrigerant pipe 591*a* via a connection pipe 597*a* and an expansion portion 597.

The clothes treating apparatus according to the present disclosure may include a fixing structure to fix the compressor 595 between the tub 2 and the cabinet 1.

The compressor 595 generates vibration while compressing a refrigerant discharged from the evaporator 591. When the vibration is transferred to the tub 2 or the cabinet 1, noise is generated. Therefore, the fixing structure is equipped to prevent the problem.

In order to increase efficiency of compressing the refrigerant, the compressor 595 should have a large volume. To fix such large compressor 595 between the cabinet 1 and the tub 2, the fixing structure may be provided.

Figure 5:
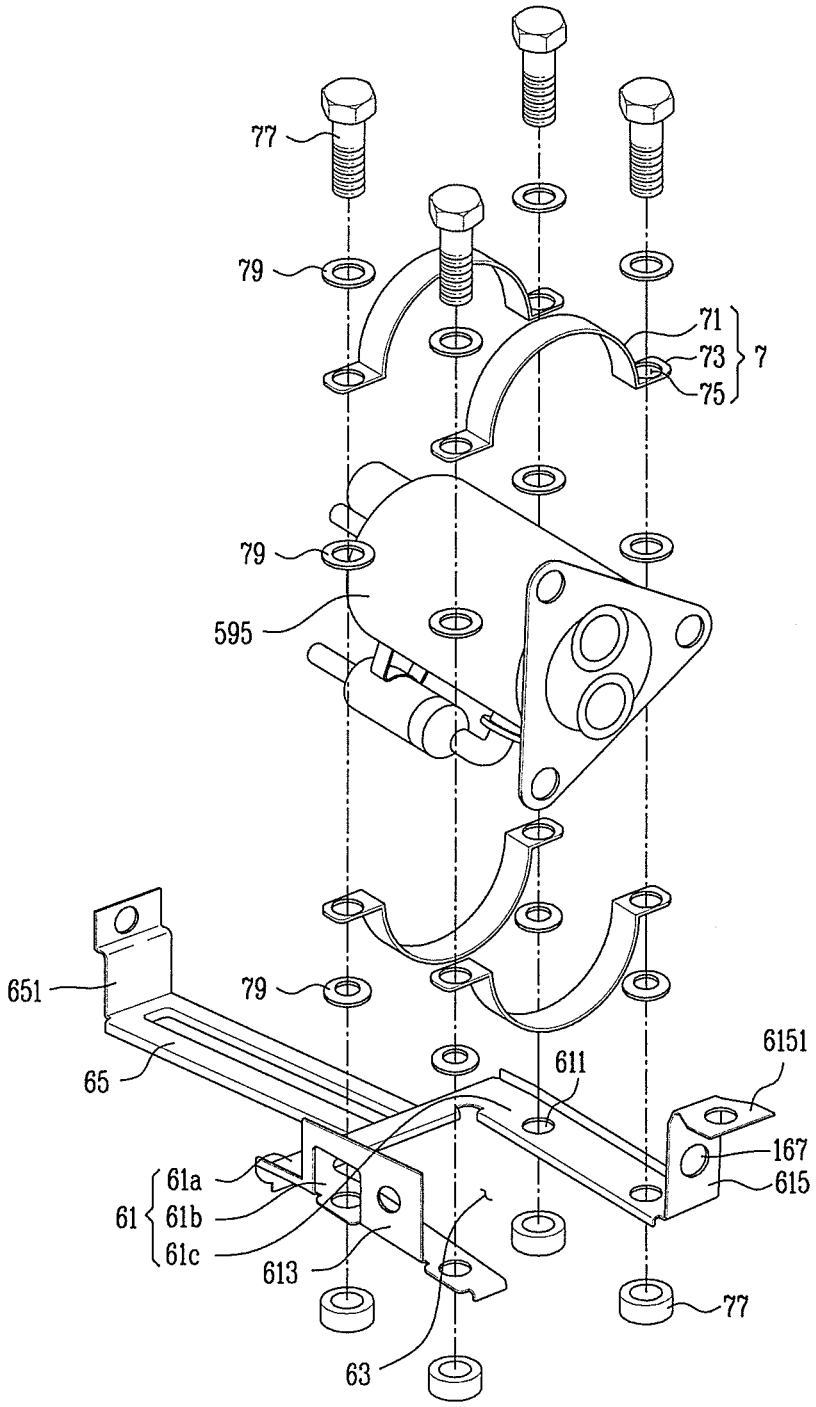
FIG. 5 is an exploded perspective view of a fixing structure provided in a clothes treating apparatus in accordance with one exemplary embodiment of the present disclosure.

The fixing structure may include a bracket assembly 6 (or supporting unit) to support the compressor 595. The bracket assembly 6 may be a bracket assembly for the compressor. As illustrated in FIGS. 2 and 5, the supporting unit 6 may include a main bracket 61 having a compressor accommodation region 63 for accommodating the compressor 595 therein, and a sub-bracket 65 extending from the main bracket 61. The accommodation region 63 may also be referred to as a penetrating portion through which the compressor is positioned in the main bracket 61.

The main bracket 61 may include the compressor accommodation region 63 in which the compressor 595 is accommodated or through which the compressor 595 is fixedly inserted. The compressor accommodation region 63 may be formed by cutting off a central portion of the main bracket 61, and may have a shape corresponding to a shape of the compressor 595 which is accommodated or inserted therein.

The compressor accommodation region 63 may be formed in a manner that every surface thereof is surrounded by the main bracket 61. In other words, when the compressor 595 is fixedly inserted into the compressor accommodation region 63, the compressor accommodation region 63 may surround the periphery of the compressor 595.

Alternatively, as illustrated in FIG. 5, the main bracket 61 may surround the compressor accommodation region 63, except for a partial surface thereof. In other words, when the compressor 595 is fixedly inserted into the compressor accommodation region 63, the compressor accommodation region 63 may surround the compressor 595 except for a part of the periphery of the compressor.

Hereinafter, for sake of convenience, description will be given of a case where the compressor accommodation region in which the compressor is fixedly inserted has a partial surface open.

The main bracket 61 may include a front member 61*a* facing a front panel of the cabinet 1 and located at a front side based on the compressor accommodation region 63, a left member 61*b* located at a left side based on the compressor accommodation region 63, and a right member 61*c* located at a right side based on the compressor accommodation region 63. The left member 61*b* and the right member 61*c* may be positioned a prescribed distance from each other. The prescribed distance may correspond to the width of the compressor. The prescribed distance may be greater than the width so that the compressor may be positioned therebetween. The left and right members 61*b* and 61*c* may be referred to as an arm or leg of the main bracket 61.

The main bracket 61 may be provided on an upper portion of the tub 2, and located between the duct 51 and a rear panel of the cabinet 1. The main bracket 61 may include a rear support rib 615 perpendicularly protruding from the main bracket 61 to be fixed to the rear panel or top panel of the cabinet 1, and a side support rib 613 perpendicularly protruding from the main bracket 61 to be fixed to a side panel or top panel of the cabinet 1.

The side support rib 613 and the rear support rib 615 may include a side bent portion and a rear bent portion 6151, respectively, each of which is formed by bending another end thereof to be locked at the upper portion of the side or rear panel of the cabinet 1.

Here, the side support rib 613 may be provided at the left member 61*b* or the right member 61*c* and fixed to the side panel of the cabinet 1. Also, the rear support rib 615 may be provided at one or both of the left member 61*b* and the right member 61*c* and fixed to the rear panel of the cabinet 1.

A fixing hole may be provided at one of the side support rib 613 or the side bent portion, such that the one of the side support rib 613 or the side bent portion is fixed to the side panel of the cabinet 1 therethrough. This structure may equally be applied to the rear support rib 615 or the rear bent portion 6151.

Meanwhile, the fixing structure may include a clamp 7 to fix the compressor 595 to the bracket assembly 6. The compressor 595 may be inserted through the compressor accommodation region 63 and fixed to the main bracket 61 using the clamp 7.

The clamp 7 refers to a member which surrounds an outer surface of the compressor 595 for fixing it. In detail, the clamp 7 may include a body 71 to surround the outer surface of the compressor 595 for fixing it, and coupling portions 73 provided at end portions of the body 71. The coupling portions may be lugs, tabs, or the like.

The body 71 may have a shape corresponding to an outer shape of the compressor 595, and surround the outer surface of the compressor 595 to fix the compressor 595. The compressor 595 according to one embodiment of the present disclosure is in a cylindrical shape with an outer circumferential surface. Therefore, the body 71 may have a corresponding circular shape.

To easily assemble the body 71 to the compressor 595, the body 71 may include upper and lower bodies 71 to fix the compressor 595 in a surrounding manner. However, the body 71 may also be provided by three or four in number to surround the outer surface of the compressor 595.

The lugs 73 may be formed to protrude from the ends of the body 71, and each lug 73 may include a lug hole 75 through which a coupling member 77 (or fastener) is fixedly inserted. Meanwhile, the main bracket 61 may include clamp coupling holes 611 formed to communicate with the lug holes 75 to fix the clamp 7.

When the upper and lower bodies 71 are provided, the lugs 73 located at the upper and lower bodies are aligned to face each other, and thus, the lug holes 75 communicate with each other. Here, the lug holes 75 are aligned to communicate with the clamp coupling holes 611 formed at the main bracket 61, and thereafter the clamp 7 for fixing the compressor 595 is fixed to the main bracket 61 using the coupling members 77. The coupling members 77 may include bolts, nuts and the like, and any configuration may be applied if it can fix the clamp 7 to the main bracket 61.

To prevent vibration generated in the compressor 595 from being transferred to the main bracket 61, vibration-insulating members 79 may be provided between the coupling member and the lug, between the lugs, between the lug and the main bracket 61 and between the main bracket 61, the coupling member, or a combination thereof.

Hereinafter, description will be given of a coupling method for the compressor 595 and configuration of the bracket assembly to both sustain a weight of the compressor 595 and prevent the compressor 595 from coming loose due to vibration while the compressor 595 is driven.

As illustrated in FIG. 5, two clamps 7 may be used for fixing the compressor 595. The clamps 7 may be configured to surround the compressor when installed on the compressor 595. The two clamps 7 may be spaced apart from each other by a predetermined distance. The lug holes 75 of the two clamps 7 may be aligned with the two clamp coupling holes 611 provided at the left member 61*b* and the right member 61*c*, respectively, to communicate with and be fixed to each other. Accordingly, a structure of supporting the compressor 595 at four points may be formed (e.g., four point configuration).

Figure 6:
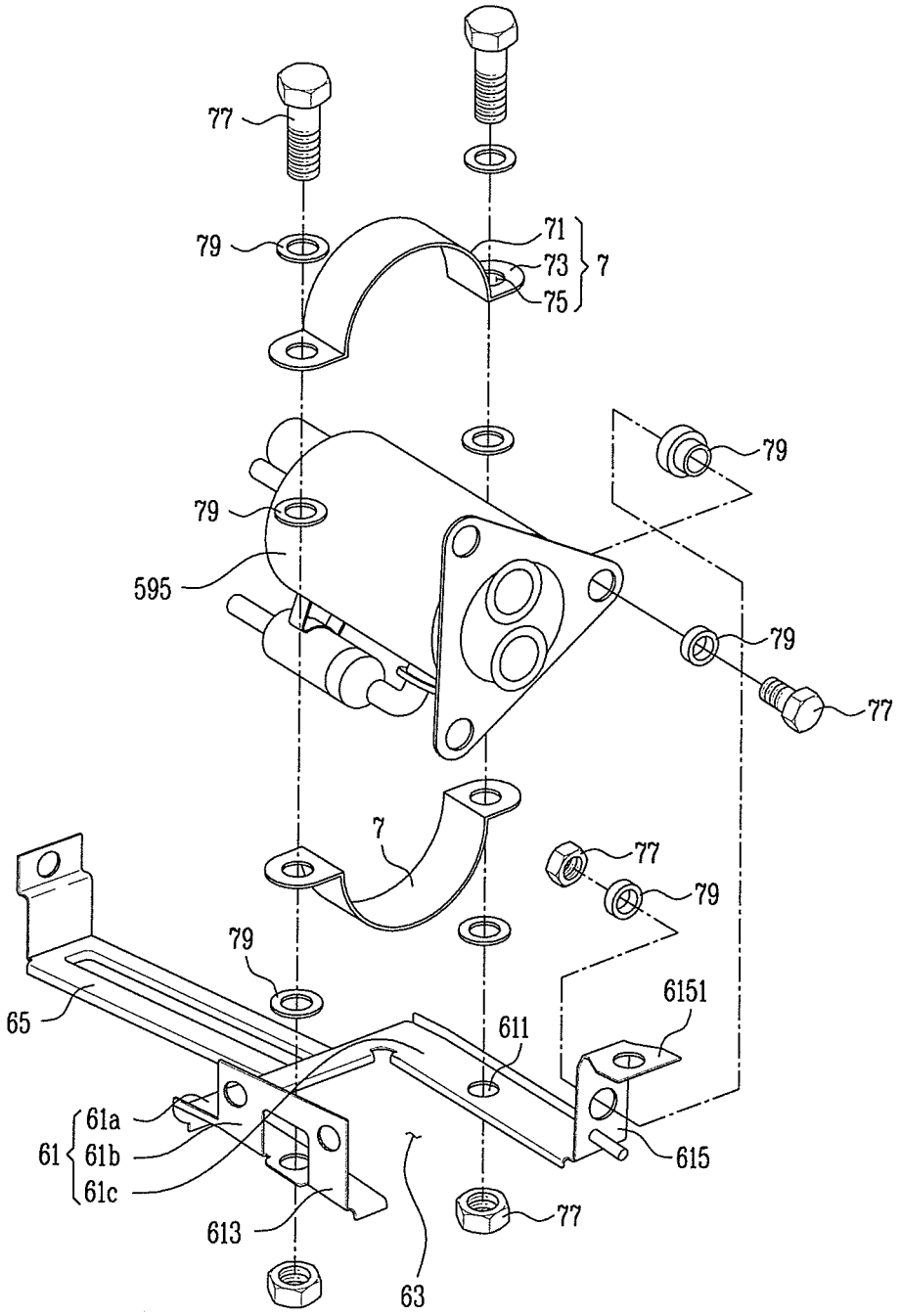
FIG. 6 is an exploded perspective view of a fixing structure provided in a clothes treating apparatus in accordance with another exemplary embodiment of the present disclosure.

Alternatively, as illustrated in FIG. 6, a three point configuration may be used to support the compressor. A three-point supporting hole 167 may be provided at the side support rib 613 or the rear support rib 615, and one clamp 7 for fixing the compressor 595 may be used. The lug holes 75 of the clamp 7 may be aligned with the clamp coupling holes 611 provided at the left member 61*b* and the right member 61*c*, respectively, to communicate with and be fixed to each other, and one side of the compressor 595 may be fixed to the three-point supporting hole 617. Accordingly, a structure of supporting the compressor 595 at three points may be formed (e.g., three point configuration).

Also, the bracket assembly 6 may include a sub-bracket 65 that extends from the main bracket 61. The sub-bracket 65 is preferably formed in a manner of extending from the front member 61*a* toward a front side of the cabinet 1. The sub-bracket 65 may extend parallel to the main bracket 61, for example, the left member 61*b* and the right member 61*c*.

The sub-bracket 65 may include a front support rib 651 perpendicularly protruding from an end thereof. The sub-bracket 65 may be fixed to the front panel of the cabinet 1 using the front support rib 651. Alternatively, the sub-bracket 65 may be fixed to a module of the hot air supply device 5 forming the circulation passage 51, 53 and 55 using the front support rib 651. Therefore, the weight of the compressor 595 that the main bracket 61 must bear may be distributed and vibration dampening provided.

As broadly described and embodied herein, an aspect of the detailed description is to provide a clothes treating apparatus having a fixing structure for fixing a compressor in the clothes treating apparatus.

Another aspect of the detailed description is to provide a clothes treating apparatus having a fixing structure for preventing vibration generated in a compressor from being transferred to the clothes treating apparatus.

Another aspect of the detailed description is to provide a clothes treating apparatus having a fixing structure with a structure, by which a large compressor can be efficiently provided in the clothes treating apparatus.

To achieve these and other advantages and in accordance with the purpose of this specification, as embodied and broadly described herein, there is provided a clothes treating apparatus including a cabinet defining appearance thereof, a clothes receiving unit provided in the cabinet and configured to receive clothes therein, a hot air supply unit provided with a heat exchanger to heat air supplied into the clothes receiving unit and a compressor connected to the heat exchanger to compress a refrigerant, and a bracket assembly provided in the cabinet to support the compressor, wherein the bracket assembly includes a main bracket having a penetrating portion in which the compressor is accommodated, and a sub-bracket extending from the main bracket.

The bracket assembly may include a main bracket having a penetrating portion through which the compressor is inserted for installation, and a sub-bracket extending from the main bracket. The main bracket may be fixed to a rear panel or a side panel of the cabinet. The sub-bracket may be fixed to a front panel of the cabinet.

The hot air supply unit may further include a circulation passage provided at an upper portion of the clothes receiving unit and allowing air to circulate into the clothes receiving unit. The sub-bracket may be fixed to the circulation passage.

Also, the present disclosure may provide a clothes treating apparatus further including a clamp configured to fix the compressor to the main bracket. The clamp may include a body fixing the compressor in a manner of surrounding an outer surface of the compressor, and coupling portions provided at ends of the body to fix the body to the main bracket. The body may include an upper body surrounding an upper portion of the compressor, and a lower body surrounding a lower portion of the compressor.

In accordance with one embodiment of the present disclosure, the clamp may be provided by one to fix the compressor to the main bracket. The one clamp may fix one side of the compressor to the main bracket. In accordance with another embodiment of the present disclosure, the clamp may be provided by two to fix the compressor to the main bracket.

The present disclosure may provide a clothes treating apparatus having a fixing structure for fixing a compressor in the clothes treating apparatus.

The present disclosure may provide a clothes treating apparatus having a fixing structure, capable of preventing vibration generated in a compressor from being transferred to the clothes treating apparatus.

The preset disclosure may provide a clothes treating apparatus having a fixing structure, capable of efficiently installing a large compressor in the clothes treating apparatus.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A clothes treating apparatus comprising:

a cabinet that defines an outer appearance of the clothes treating apparatus;

a clothes receiving unit provided in the cabinet and configured to receive clothes therein;

a hot air supply device provided with a heat exchanger to heat air supplied into the clothes receiving unit and a compressor connected to the heat exchanger to compress a refrigerant, wherein the compressor is disposed at a position higher than the clothes receiving unit; and a bracket assembly coupled to the cabinet to support the compressor, wherein the bracket assembly includes:

a main bracket having a compressor accommodation region through which the compressor penetrates the main bracket so that the main bracket surrounds a periphery of the compressor, wherein the main bracket is fixed to at least one of a rear panel or a side panel of the cabinet, and a sub-bracket that extends from the main bracket, wherein the sub-bracket is fixed to a front panel of the cabinet.

2. The apparatus of claim 1, wherein the hot air supply device includes a circulation passage provided at an upper portion of the clothes receiving device unit that allows air to circulate into the clothes receiving unit, wherein the sub-bracket is fixed to the circulation passage.

3. The apparatus of claim 1, further comprising a clamp configured to fix the compressor to the main bracket.

4. The apparatus of claim 3, wherein the clamp includes:

a body that surrounds an outer surface of the compressor, and coupling portions provided at ends of the body to couple the body to the main bracket.

5. The apparatus of claim 4, wherein the body of the clamp includes:

an upper body that surrounds an upper portion of the compressor, and a lower body that surrounds a lower portion of the compressor.

6. The apparatus of claim 4, wherein the bracket assembly includes only one clamp to fix the compressor to the main bracket, the clamp fixing one side of the compressor to the main bracket.

7. The apparatus of claim 6, wherein the bracket assembly has a three point configuration in which three fasteners fasten the compressor to the main bracket at three points, wherein two of the fasteners fasten two coupling portions of the clamp to the main bracket and one fastener fastens the compressor to a rear support rib of the main bracket.

8. The apparatus of claim 4, wherein the bracket assembly includes at least two clamps to fix the compressor to the main bracket.

9. The apparatus of claim 7, wherein the bracket assembly has a four point configuration in which four fasteners fasten the compressor to the main bracket at four points, wherein the four fasteners fasten four coupling portions of the clamps to the main bracket.

10. The apparatus of claim 3, wherein at least one vibration-insulating member is provided between the clamp and the main bracket to reduce transfer of vibration from the compressor to the main bracket.

11. The apparatus of claim 1, wherein the main bracket includes a first arm and a second arm that extends parallel to the first arm and toward the rear panel, the second arm being spaced a prescribed distance from the first arm to form the compressor accommodation region.

12. The apparatus of claim 11, wherein the prescribed distance between the first arm and the second arm is greater than a width of the compressor to accommodate the compressor between the first arm and the second arm.

13. The apparatus of claim 11, wherein the compressor is positioned in the accommodation region of the main bracket between the first arm and the second arm such that a portion of the compressor is positioned above the main bracket and a portion of the compressor is positioned below the main bracket.

14. The apparatus of claim 11, wherein the first arm and the second arm extend parallel to lateral sides of the compressor.

15. The apparatus of claim 11, wherein the sub-bracket extends parallel to the first and second arms of the main bracket, the sub-bracket extending toward the front panel of the cabinet and the first and second arms of the main bracket extending toward the rear panel of the cabinet.

16. The apparatus of claim 15, wherein the main bracket includes a rear support rib provided on the first arm and a side support rib provided on the second arm to attach the bracket assembly to the cabinet, wherein the rear support rib and the side support rib extend upward perpendicular to the first and second arms.

17. The apparatus of claim 16, wherein the rear support rib is fixed to the rear panel or a top panel of the cabinet and the side support rib is fixed to a side panel of the cabinet.

18. The apparatus of claim 1, wherein the bracket assembly is positioned between a top panel of the cabinet and the clothes receiving unit such that the bracket assembly vertically overlaps the clothes receiving unit.

19. A clothes treating apparatus comprising:

a cabinet having a front panel, a rear panel and at least one side panel;

a clothes receiving unit provided at the cabinet, the clothes receiving unit to receive clothes;

a heat exchanger to heat air supplied to the clothes receiving unit;

a compressor coupled to the heat exchanger to compress a refrigerant, wherein the compressor is disposed at a position higher than the clothes receiving unit; and a bracket assembly coupled to the cabinet to support the compressor, wherein the bracket assembly includes:

a first bracket having a compressor accommodation region to support the compressor such that the first bracket is provided at a portion of the compressor, wherein the first bracket is attached to at least one of the rear panel or the side panel of the cabinet, and a second bracket that extends from the first bracket toward the front panel, wherein the first bracket is attached to the front panel of the cabinet.

20. The apparatus of claim 19, wherein the main bracket includes a first arm and a second arm that extends parallel to the first arm and toward the rear panel, the second arm being spaced a prescribed distance from the first arm to fotin the compressor accommodation region, and wherein the prescribed distance between the first arm and the second arm is greater than a width of the compressor to accommodate the compressor between the first arm and the second arm.

* * * * *